US006056044A

United States Patent [19]

Benson et al.

[11] Patent Number: 6,056,044

[45] Date of Patent: May 2, 2000

[54] HEAT PIPE WITH IMPROVED WICK STRUCTURES

[75] Inventors: David A. Benson; Charles V. Robino; David W. Palmer, all of Albuquerque; Stanley H. Kravitz, Placitas, all of N.Mex.

[73] Assignee: Sandia Corporation, Albuquerque, N.Mex.

[21] Appl. No.: 08/987,960

[22] Filed: Dec. 10, 1997

Related U.S. Application Data

[63] Continuation-in-part of application No. 08/593,596, Jan. 29, 1996, Pat. No. 5,769,154.

[51] Int. Cl.[7] ..... F28D 15/00

[52] U.S. Cl. ..... 165/104.26; 165/911

[58] Field of Search ..... 165/104.26, 133, 165/911

[56] References Cited

U.S. PATENT DOCUMENTS

| | | | |
|---|---|---|---|
| 3,786,861 | 1/1974 | Eggers | 165/104.26 |
| 4,004,441 | 1/1977 | Leszak | 165/104.26 X |
| 4,274,479 | 6/1981 | Eastman | 165/104.26 |
| 4,322,737 | 3/1982 | Sliwa, Jr. | 357/82 |
| 4,545,427 | 10/1985 | Alario et al. | 165/104.26 |
| 4,573,067 | 2/1986 | Tuckerman et al. | 357/82 |
| 4,819,719 | 4/1989 | Grote et al. | 165/104.26 |
| 4,833,567 | 5/1989 | Saaski et al. | 165/104.33 X |
| 4,846,263 | 7/1989 | Miyazaki et al. | 165/104.26 |
| 4,880,053 | 11/1989 | Sheyman | 165/104.26 |
| 5,216,580 | 6/1993 | Davidson et al. | 165/104.33 X |

FOREIGN PATENT DOCUMENTS

| | | | |
|---|---|---|---|
| 0012991 | 1/1983 | Japan | 165/104.26 |
| 0066094 | 4/1985 | Japan | 165/133 |
| 0203894 | 8/1989 | Japan | 165/104.26 |
| 0641009 | 1/1979 | U.S.S.R. | 165/104.26 |
| 0659883 | 4/1979 | U.S.S.R. | 165/104.26 |
| 0974088 | 11/1982 | U.S.S.R. | 165/104.26 |
| 001740951 | 6/1992 | U.S.S.R. | 165/104.26 |

*Primary Examiner*—Christopher Atkinson
*Attorney, Agent, or Firm*—Gregory A. Cone

[57] ABSTRACT

An improved planar heat pipe wick structure having projections formed by micromachining processes. The projections form arrays of interlocking, semi-closed structures with multiple flow paths on the substrate. The projections also include overhanging caps at their tops to increase the capillary pumping action of the wick structure. The capped projections can be formed in stacked layers. Another layer of smaller, more closely spaced projections without caps can also be formed on the substrate in between the capped projections. Inexpensive materials such as Kovar can be used as substrates, and the projections can be formed by electrodepositing nickel through photoresist masks.

9 Claims, 5 Drawing Sheets

HEAT PIPE WITH IMPROVED WICK STRUCTURES

CROSS-REFERENCE TO RELATED APPLICATIONS

This application is a continuation-in-part of U.S. Ser. No. 08/593,596 for "Heat Pipe with Embedded Wick Structure" filed on Jan. 29, 1996, now U.S. Pat. No. 5,769,154. The disclosure of this parent application is incorporated by reference herein in its entirety.

STATEMENT REGARDING FEDERALLY SPONSORED RESEARCH OR DEVELOPMENT

This invention was made with Government support under Contract DE-AC04-94AL85000 awarded by the U.S. Department of Energy. The Government has certain rights in the invention.

BACKGROUND OF THE INVENTION

This invention relates to the field of heat dissipation devices, specifically miniature heat pipes with optimized embedded wick structures. Increasing power density in electronic circuits creates a need for improvements to systems for transferring heat away from the circuit. Integrated circuits (ICs) typically operate at power densities of up to and greater than 15 W/cm$^2$. The power density will increase as the level of integration and speed of operation increase. Other systems, such as concentrating photovoltaic arrays, must dissipate externally-applied heat loads. Advances in heat dissipation technology can eliminate the current need for mechanically pumped liquid cooling systems.

Heat spreaders can help improve heat rejection from integrated circuits. A heat spreader is a thin substrate that transfers heat from the IC and spreads the energy over a large surface of a heat sink. Heat transfer through a bulk material heat spreader produces a temperature gradient across the heat spreader, affecting the size and efficiency of the heat spreaders. Diamond films are sometimes used as heat spreaders since diamond is 50 times more conductive than alumina materials and therefore produce a smaller temperature gradient. Diamond substrates are prohibitively expensive, however.

Heat pipes can also help improve heat rejection from integrated circuits. Micro-heat pipes use small ducts filled with a working fluid to transfer heat from high temperature devices. See Cotter, "Principles and Prospects for Micro-heat Pipes," Proc. of the 5th Int. Heat Pipe Conf. The ducts discussed therein are typically straight channels, cut or milled into a surface. Evaporation and condensation of the fluid transfers heat through the duct. The fluid vaporizes in the heated region of the duct. The vapor travels to the cooled section of the duct, where it condenses. The condensed liquid collects in the corners of the duct, and capillary forces pull the fluid back to the evaporator region. The fluid is in a saturated state so the inside of the duct is nearly isothermal.

Unfortunately, poor fluid redistribution by the duct corner crevices limits the performance of the heat pipe. Fluid has only one path to return to the heated regions, and capillary forces in the duct corner crevices do not transport the fluid quickly enough for efficient operation. There is a need for a heat pipe that can spread fluid more completely and efficiently, and therefore can remove heat energy more completely and efficiently.

BRIEF SUMMARY OF THE INVENTION

The present invention provides an improved heat pipe system for the removal of heat from a high temperature device. The present invention includes a wick structure specifically optimized for distributing fluid within the heat pipe system. The wick structure allows fluid flow in multiple directions, improving the efficiency of the heat pipe system. The wick structure of the present invention returns fluid to heated regions faster than previous wick structures, increasing the rate of heat rejection from the high temperature device. Faster, multidirectional fluid flow improves the performance of the heat pipe system by reducing the temperature gradient across the heat pipe system.

The improved wick structure of the present invention offers several advantages. The simple rectangular cross sections of the projections in the parent application referenced above have been modified to include an additional domed cap on top, taking the configuration of a mushroom. The additional corner formed between the base of the domed cap and the top of the rectangular portion provides for added capillary pumping. It also caps the liquid flow channel to isolate it from the high velocity vapor flow. This structure can be formed by over-plating the metal utilized to form the projections above the surface of the photoresist mask used to delineate the projections on the substrate on which they are formed. Once the trenches in the mask are filled, the over-plating above the mask forms the domed caps of the mushroom-shaped cross-sections of the improved projections.

Also, this technique can be utilized to form multiple layers of these improved projections, one on top of the other by multiple mask and plate cycles. This is of particular use at higher heat densities (greater than about 10 W/cm$^2$) where the local heat flux can cause boiling and dry-out of the wick structure in the local area. This dryout significantly lowers the heat transfer ability of the heat pipe. By forming stacked structures of this improved type, this local effect can be ameliorated. Even though local dry-out can still occur at the base of the projections, the wick will remain wetted in the upper levels of the stacked structure. In this manner, the heat pipe continues to transfer heat efficiently in the immediate vicinity of the dry-out area.

In another aspect of this invention, even finer structures can be formed within the main array of projections in the wick system. These finer projections are less than the height of the main set of projections and will normally be employed in areas of highest heat flux into the substrate. They would not normally have cap structures at their terminal ends. These finer structures either by themselves or in conjunction with the main set of projections with the cap structures can serve to mitigate gravitation dry-out effects found in aeronautical applications with high acceleration forces that would other cause the working fluid to flow away for ordinary wick structures.

In yet another aspect, these improved structures can be fabricated with varying spacings between the projections in the wick structure to optimize capillary pumping in high heat flux areas (close spacing) and to optimize bulk fluid return flow from the low heat flux areas (wider spacing).

The region of the heat pipe system containing the wick structure is in contact with one or more high temperature sources. The heat pipe system contains a working fluid. Heat from a high temperature source vaporizes the fluid. The heated vapor travels to cooled regions of the heat pipe system, where it condenses and flows into the wick structure. The wick structure distributes the liquid over the wick structure's surface, where the liquid can again be vaporized.

The wick structure forms semiclosed cells interconnected in multiple directions. The resulting effective small pore radius maximizes capillary pumping action. The capillary pumping action distributes the liquid over the wick structure faster than possible with previous wick structures, resulting in more efficient heat transfer by the heat pipe system while minimizing hot spots. The optimal liquid distribution keeps all parts of the structure saturated with liquid. The semi-closed cells can be made in several shapes, including crosses, ells, and tees. The interconnected semiclosed cells allow for multiple flow paths. This creates the important advantage of mitigating blockage effects from small particles that will almost inevitably clog some of the flow channels. With this improved wick structure, even if some of the flow paths become blocked, the rest will remain open, and the working fluid will continue to flow through the device and provide the cooling. The substrate/wall material bearing the wick structure can be bonded to the rest of the heat pipe system by boron-phosphorous-silicate-glass bonding in the case of silicon wall materials. Welding or brazing can be used to bond metal wall materials together. Acetone, water, freon, and alcohols are suitable working fluids.

DETAILED DESCRIPTION OF THE INVENTION

Figure 1:
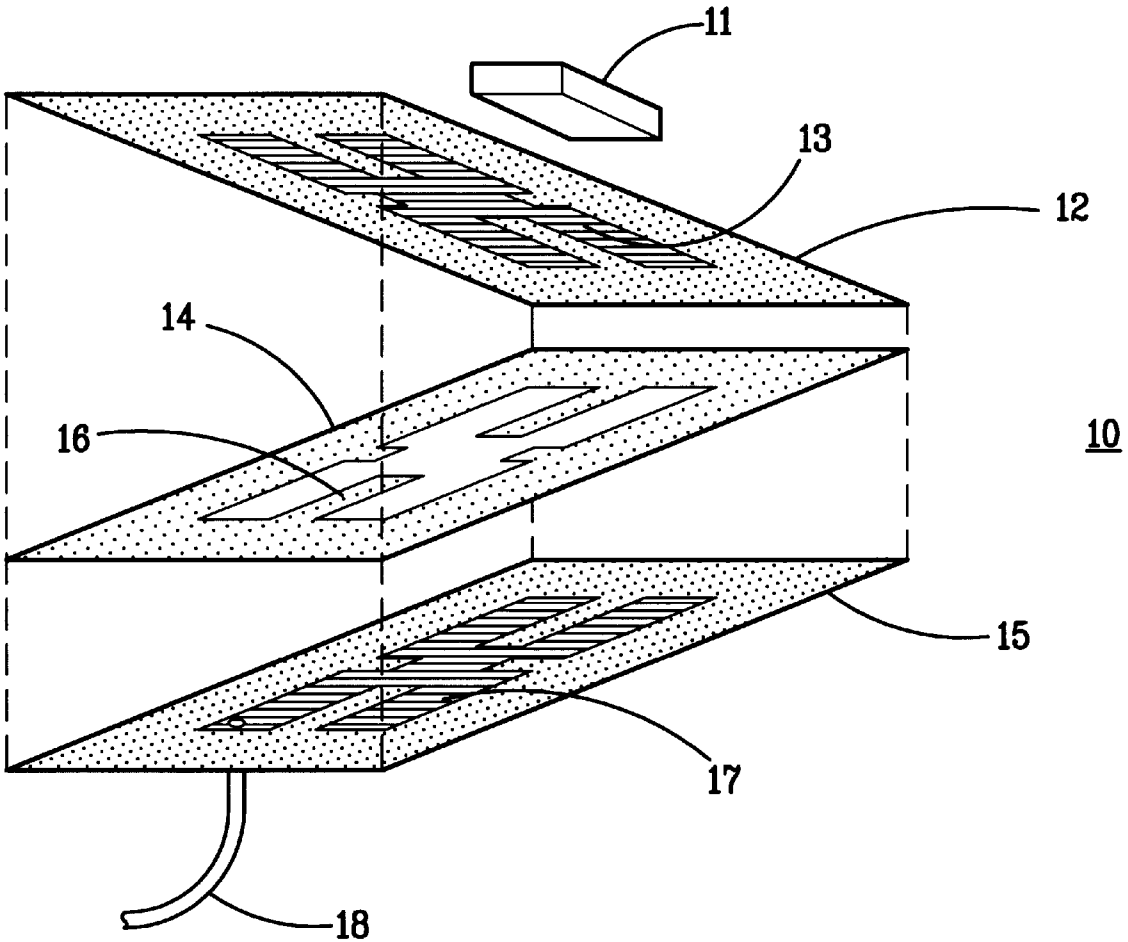
FIG. 1 is an exploded view of the basis structure of the heat pipe that incorporates the improved wick structure.

One embodiment of the basic construction of the heat pipe 10 of this invention is shown in FIG. 1. The heat is produced by a source, here a microelectronic integrated circuit chip 11. The chip 11 is affixed to outside surface of the upper substrate wall 12, with a wick structure 13 being formed on the inside surface of the upper substrate wall 12. The scale of the individual projections that comprise the wick structure is too small to show their details in this view. Since the wick structure 13 is normally formed by a mask, not shown, onto which is electrodeposited a metal to form the projections of the wick structure, the projections are deposited onto the substrate 13 rather than being formed by etching down into the substrate. This being the case, a spacer plate 14 is used to separate the upper substrate wall 12 from the lower substrate wall 15. The spacer plate 14 can also include support fingers 16 which increase the structural integrity of the heat pipe structure 10 as it undergoes its thermal cycles on and off. The fingers also act as heat transfer vias between the upper and lower substrate walls, 12, 15. The lower substrate wall 15 is shown in this view with a wick structure 17 formed thereon. This is an optional structure that is used in high heat load applications. In lower heat load situations the wick structure 17 could be absent from the surface of the lower substrate wall 15. Also shown in this view is a fill tube used during the construction of the heat pipe 10 to introduce the working fluid into the interior of the heat pipe 10 once the various layers have been sealed together. Once the fluid had been introduced, the fill tube 18 would be crimped or otherwise sealed off, and its excess length would be removed. Below the lower substrate wall 15 would be a heat sink of some conventional type, not shown here.

It should be noted that, although the substrate upon which the wick structure is formed is normally planar, this need not always be the case. In some situations, the substrate may also serve as a structural element for a larger assembly and have some degree of curvature to it. This is allowable if the radius of curvature is sufficiently greater than the size of the projections so as not to affect the efficiency of the heat pipe.

Figure 2:
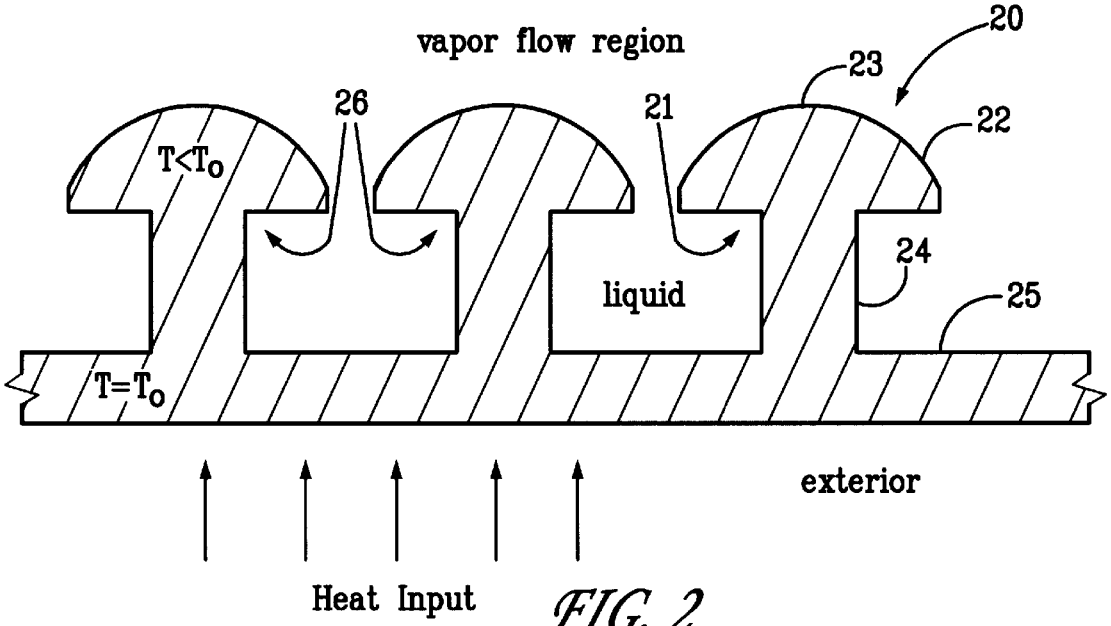
FIG. 2 is a cross-sectional view of the mushroom-shaped aspect of the improved wick structure projections.
Figure 4A:
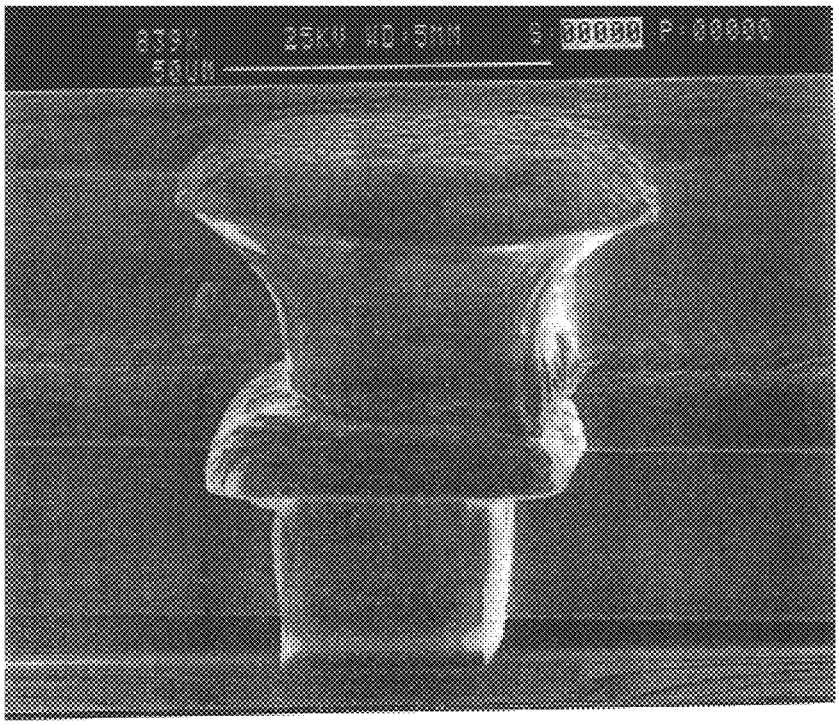
FIG. 4A is a side view of one end of one arm of the cruciform structures of FIG. 3B.
Figure 4B:
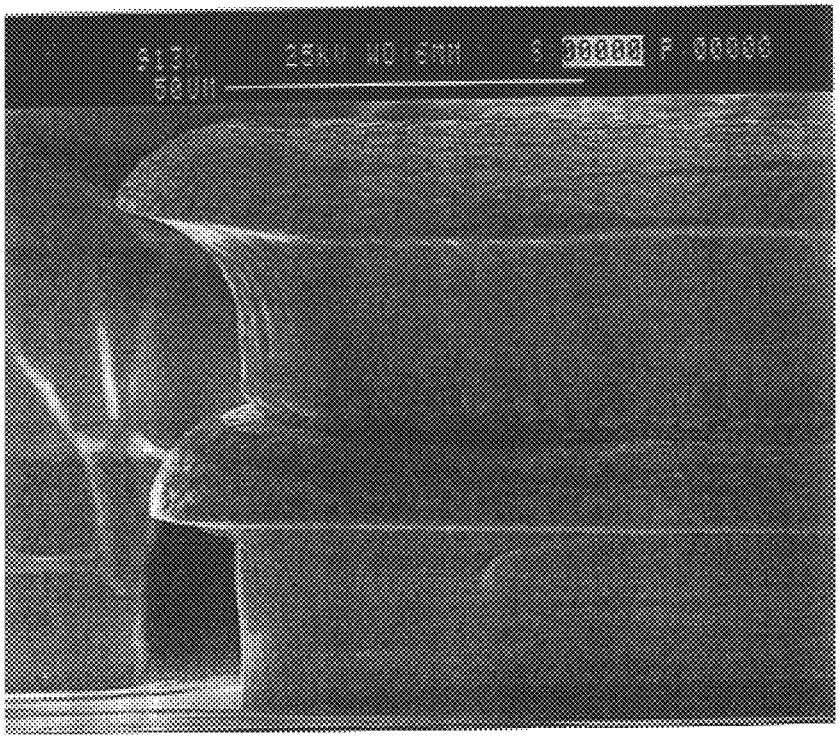
FIG. 4B is a side view of the side of the one of the arms of the cruciform structures of FIG. 3B.

Shown in FIG. 2 and many of the succeeding figures is the improved wick structure projection with the mushroom shape. This view shows three of the 'mushroom' shaped cross-sections of the projections 20 that make up the improved wick structure. The 'stalk' 24 of the projection is fixed to the surface 25 of the substrate and has the cap 22 formed on top of it. The cap 22 has a domed upper surface 23 and a lower surface 21. This lower surface will sometimes be planar as shown here but may also be somewhat curved as shown in FIGS. 4A and 4B due to electrodeposition processing effects. Note the corners 26 formed by the intersection of the lower surfaces 21 with the upper portion of the stalk 24. These improved projections are made by photo-defining the desired wick structure and using an electrodeposition process to over plate the mask defined photo resist layer, not shown. The photoresist layer would be as high as the lower surface 21. Over plating above this level results in the formation of the caps 22.

The undesired dry out effects are mitigated in this mushroom structure by the following mechanisms. The vapor created by evaporation of the working fluid on the hot side of the heat pipe flows rapidly in the direction opposite to the liquid flow, thereby impeding the return of the liquid to the evaporation zone. The cap of the structures isolates the vapor flow since liquid flows mainly below the cap while vapor is isolated by the cap divider to the region above the cap. The drag of the vapor flowing at speeds 10 to 100 times that of the liquid is thus not as important an effect in preventing the return of the liquid to the point of evaporation. The cap 22 features also give a second set of corners 26 into which the fluid is drawn by capillary action. This prevents dry out in marginal transport conditions. The temperature gradient toward the top or vapor flow region results in a lower temperature near the top of the structure also. This lower temperature is less likely to exceed the liquid interface temperature at which film boiling becomes unstable and vigorously boils the fluid from the wick. Thus the second corner 26 produced here with its lower temperature is effective in reducing the film boiling limit of dry out. For conditions in which the liquid does boil, the cover formed by the caps 22 on the liquid region will prevent the mechanical loss of fluid or "splashing" to a greater extent than for an open wick channel without the caps.

Figure 3A:
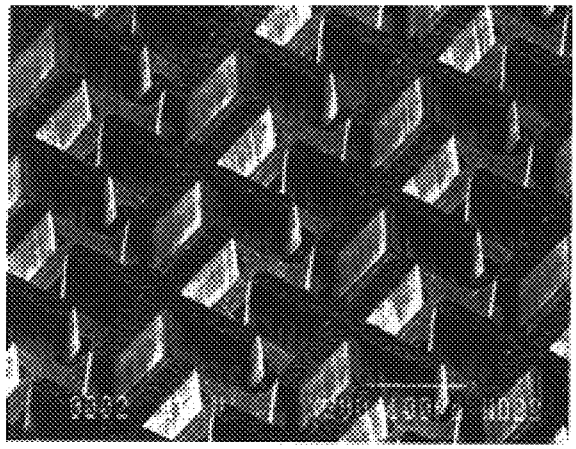
FIGS. 3A and 3B are perspective views of the stages of formation of the improved wick structure, with FIG. 3A showing an intermediate form of the projections prior to formation of the domed cap and with FIG. 3B showing the final form of the projections with the domed cap.
Figure 3B:
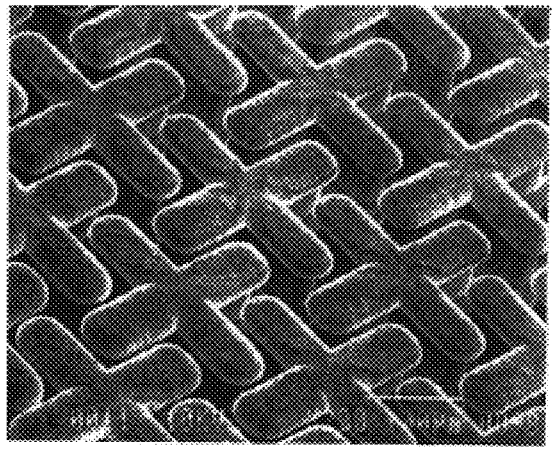

FIGS. 3A and 3B show successive stages of the formation of the improved wick structures. FIG. 3A shows an array of cruciform projections in which the electrodeposition has been terminated at or below the top of the photo resist mask. This is the type of wick structure disclosed in U.S. Ser. No. 08/593,596 referenced above. By continuing the electrodeposition above the top of the mask, the caps shown in FIG. 2 are formed.

FIGS. 4A and 4B are a photographs of a two level 'mushroom' wick structure from an electron microscope. By stacking multiple layers of the 'mushroom' wick structure layers on top of each other, the dry out effect can be further mitigated as discussed above. FIG. 4A looks at the end of one of the cruciform arms, while FIG. 4B looks at the side of one of the arms. By viewing actual structures fabricated according to the teachings of this invention, the angle formed between the stalks and the overhanging caps can be easily seen. These angles are very effective in increasing the capillary pumping capability of these structures. These figures also illustrate the ability to create stacked structures which multiply the benefits that are exhibited even by a single layer of these mushroom shaped structures.

It should be noted that the caps do not necessarily require the domed aspect created in the illustrated embodiment. One could form a variety of shapes for the caps depending upon the processes used to create them. The important feature is creation of the overhang of the cap beyond the sides of the stalk to increase the capillary pumping ability of the projections of the heat pipe wick structure.

Figure 5:
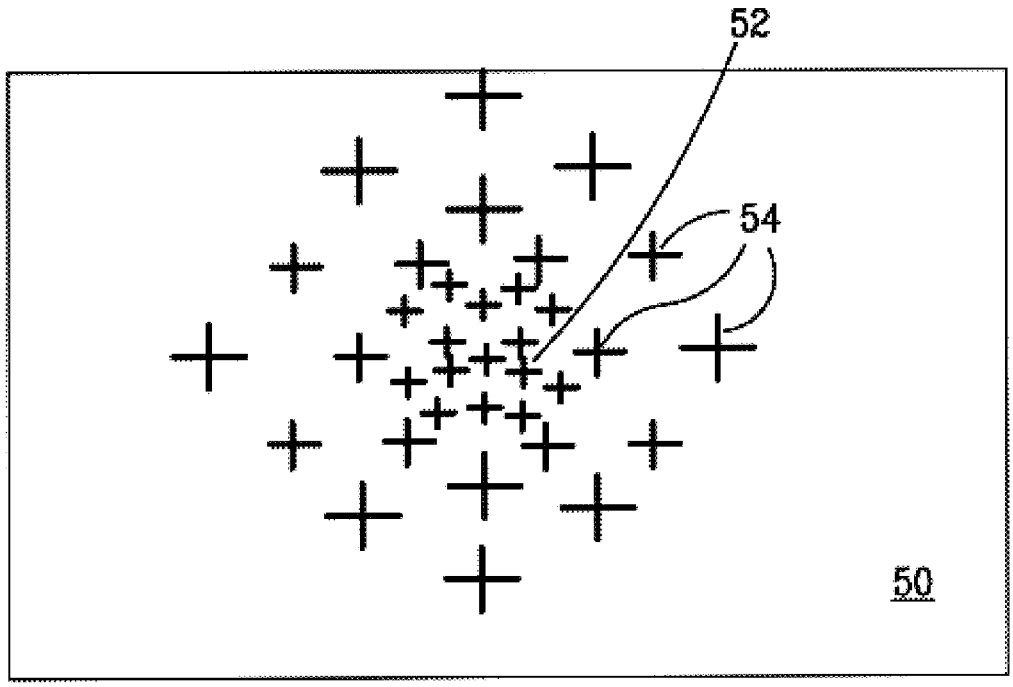
FIG. 5 is a plan view of one possible array of the projections of the wick structure that is optimized for fluid transport to an area of high heat flux.

FIG. 5 is a plan view of another aspect of the invention in which the improved wick structure has varied spacing of the individual projections 54. This embodiment has a hot spot 52 on the back side of the substrate 50. By forming the projections of the wick structures more closely together in the local area surrounding the hot spot, capillary pumping of the liquid back to the hot spot is increased. In the cooler regions on the periphery of the hot spot, the bulk of the fluid recondenses. By spacing the projections farther apart in these areas, the bulk fluid flow is increased to enable a larger volume of fluid to return to the periphery of the hot spot for subsequent capillary transport thereinto. The capillary driven pressure gradient is related to the radius of curvature in the liquid surface in the local regions of the heat pipe wick. The liquid radius of curvature in turn is related to the spacing of the features in the wick design so that smaller features tend to give a larger pressure differential to transport liquid. A second consideration is the fact that a wick with finer features has a lower permeability to liquid flow making it harder to draw liquid at some velocity across a distance on the substrate. By using the selective design of the wick so that the features are much finer in the regions approaching a dry out condition, and a larger feature scale in other areas to avoid the pressure differential necessary to pump fluid across the substrate surface, the heat pipe capability is improved.

Figure 6:
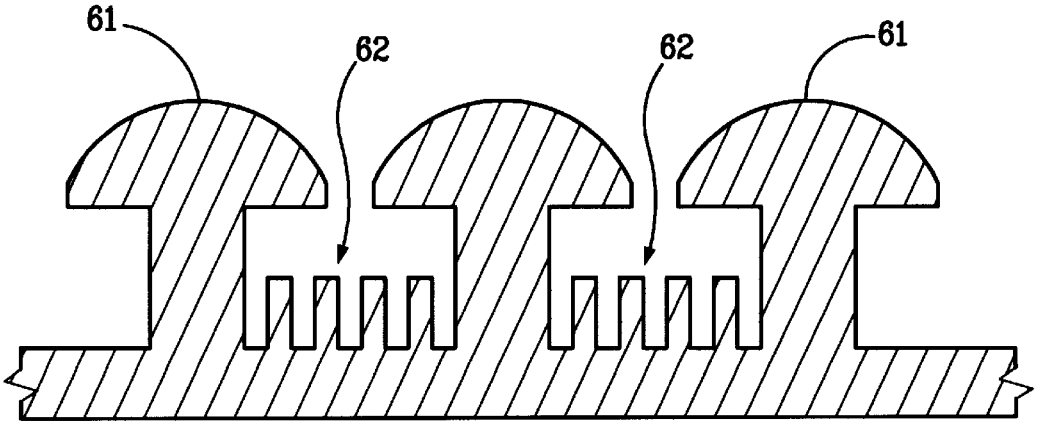
FIG. 6 is a cross-sectional view of the wick structure of FIG. 3B that incorporates additional smaller scale projections without domed caps on the surface of the substrate between the projections with the domed caps.

Another aspect of the selective design of the spacing of the projections of the wick structure is shown in FIG. 6. This cross sectional view shows the 'mushroom' shaped projections 61 of FIG. 2 in conjunction with smaller scale projections 62 formed without the 'caps' in between the larger structures 61. These smaller projections would only be formed in the areas of highest heat concentration in view of the discussion in the preceding paragraph. The smaller projections would be electrodeposited first, followed by the electrodeposition of the larger structures 61.

Figure 7A:
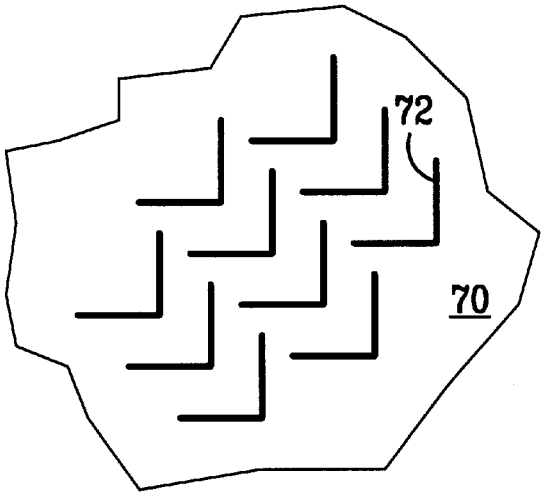
FIGS. 7A, 7B and 7C are plan views of additional configurations of the projections showing the projections configured as ell's, tee's, and as non-intersecting groups.
Figure 7B:
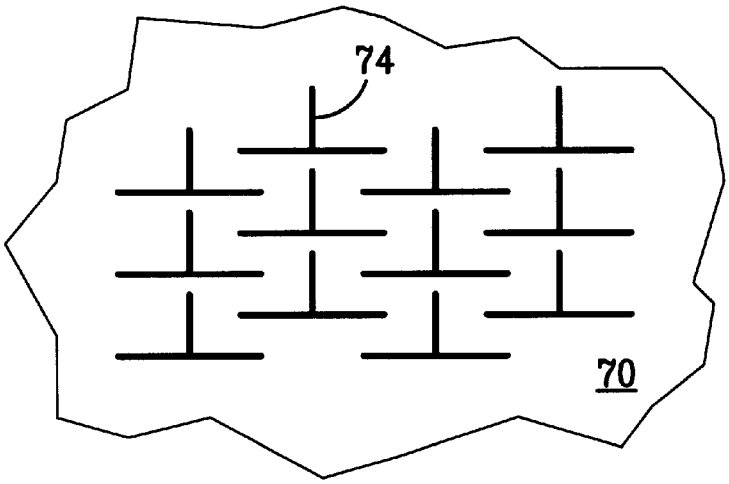
Figure 7C:
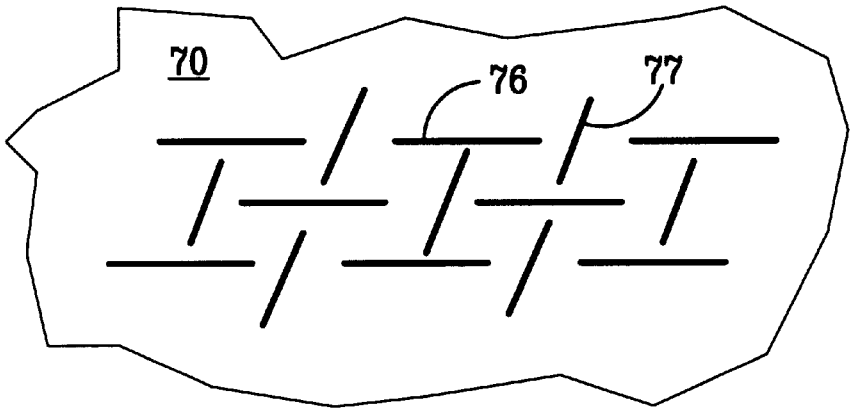

The preceding Figures have displayed cruciform projections as a preferred embodiment of the improved wick structure. Other configurations as shown in FIGS. 7A, 7B and 7C are also possible and include within the scope of this invention. FIG. 7A shows the projections configured as ell's 72, and FIG. 7B shows the projections configured as tee's 74. FIG. 7C shows that the projections need not actually intersect to be effective. This view shows two sets of projections 76, 77 that are parallel with a set, but with the sets having axes that intersect. The beneficial effect of providing multichannel flow is accomplished by these arrays and others as will be apparent to those skilled in the art.

Several other factors bear on the effectiveness of this improved heat pipe. It is desirable to have a low thermal resistance attachment of die (the heat-producing IC) to the substrate of the heat pipe. This requires a die bond that is thin and undamaged by differential thermal expansion between the die and the substrate of the heat pipe. Thus the selection of a substrate wall material with the desired thermal expansion coefficient independently of its heat transfer properties is an important design option. Overlooked by many in the field is the effect that temperature changes in the heat pipe are accompanied by a change of the internal substrate pressure that is determined by the saturated vapor pressure of the filling liquid. The design of a suitable support structure within the heat pipe substrate is essential to minimize wall deformation from the internal pressure change that could damage the die attach layer. Circuit manufacturing temperature for soldering and epoxy attach can exceed operational temperatures, so design for minimum stress is important.

The differential thermal expansion is managed in this invention by using a flexible range of wall materials. The photo deposition process is compatible with heat pipe designs in silicon disclosed in U.S. Ser. No. 08/593,596. Wick structures can be made from photo deposited gold on a silicon wafer. Nickel photo depositions on silicon have also been successfully demonstrated. Since consumer products are cost sensitive, we have also developed cost effective wick designs made on low expansion metal materials. We have made prototype substrates with Kovar wall material that matches fairly well to expansion coefficients of silicon and GaAs die materials. Additional materials such as alloy 42 and Silvar are equally appropriate for this processing. For consumer products, glass, plastics or other metals could be used and designs with multiple types of materials in different parts of the enclosure may be needed for some electronic cooling designs.

High performance and highly integrated substrates using silicon as the wall material require special attention to this support structure since the brittle nature of silicon requires the engineering of a design without high stress concentrations that would damage the substrate.

Photo deposition processing has been utilized to make the unique capped wick structures disclosed herein. The economical electroplating processes used in this method allow access to a wide range of consumer applications, as well as less cost sensitive, but high performance applications using materials such as silicon and Silvar. The process works with both silicon and with low expansion metals for substrates. For systems not affected by expansion considerations, the full range of metals including copper and aluminum can be considered for use. The photo defined plating process can be used on silicon to manufacture designs based Ser. No. 08/593,596, but enhanced to include the dry out resistant features claimed herein. As compared with the deep plasma etch process used in this reference to make the wick structures, the electrodeposition process with photo mask or LIGA replication is a low-cost production-level process making it particularly valuable for consumer level applications.

The details of the electrodeposition processes are based on application of commercial mask, photo patterning methods and electroplating. Their implementation of the process used Kovar substrate wall material. Commercial grade Kovar in sheet form was used in the as received condition and initially solvent cleaned. Oxide and other impurities were removed with an argon plasma sputter treatment. An SU-8 photo resist was spun on to the part with a thickness between 50 and 100 $\mu$m and dried. This resist layer was photo patterned with a standard contact print from a glass plate bearing the mask pattern. The resist was developed in an organic solvent. The plating surface exposed in the photo defined resist layer was cleaned with an argon sputter treatment. Nickel was electroplated to a depth of the photo resist pattern and then over plated to form the mushroom features. The plating was done in a fountain plating bath with a relatively slow solution pumping speed and mid range current density. Plating with a gold solution was also successful. Slight variations of this method were used to prepare gold and nickel wick structures on silicon substrate wall materials precoated with a thin evaporated layer of gold.

It can be readily appreciated that a number of variations to the techniques and structures disclosed herein will be apparent to those skilled in the art. The true scope of the invention is to be found in the appended claims.

What is claimed is:

1. A wick structure comprising:

a substrate; and a first plurality of discontinuous linear projections disposed thereon and extending thereabove wherein the cross section of a projection in a plane normal to the linear axis of the projection takes the shape of a mushroom, with a stalk portion attached to the substrate at its bottom end and crested by an overhanging cap that is attached to the top end of the stalk portion, wherein some of the projections are oriented in a non-parallel configuration one to another thereby providing multiple flow channels therebetween across the substrate.

2. The structure of claim 1 additionally comprising a second plurality of discontinuous linear projections of substantially similar cross section to the first plurality of projections, wherein the bottom end of a stalk portion in the cross section of the second plurality of discontinuous linear projections is attached to the top of the cap of at least a portion of the first plurality of projections.

3. The structure of claim 1 wherein the first plurality of projections is arrayed such that the spacing between projections is closer in areas of the substrate with high heat flux and the spacing is wider between projections in areas with relatively lower heat flux.

4. The structure of claim 1 further comprising a plurality of reduced height projections formed on the surface of the substrate, having a height less than the height of the stalks of the first plurality of projections, formed between at least some of the projections in the first plurality of projections, said reduced height projections having a smaller cross-sectional width and closer spacing between than do the stalks of the first plurality of projections.

5. The structure of claim 1 wherein the width of the caps is such that the size of the lower surface of the cap in combination with the upper portion of the stalk portion of the projections increases the capillary pumping ability of the first plurality of projections but is not so large as to detrimentally impede fluid flow across the perimeters of the caps.

6. The wick structure of claim 1 wherein the substrate is selected from the group consisting of silicon, Kovar, alloy 42 and Silvar.

7. The wick structure of claim 1 wherein the projections are made from material selected from the group consisting of nickel, gold and combinations thereof.

8. The wick structure of claim 1 wherein the substrate is planar.

9. A wick structure comprising:

a substrate having a first surface; and a first plurality of discontinuous linear projections disposed thereon and extending thereabove wherein the cross section of a projection in a plane normal to the linear axis of the projection takes the shape of a mushroom, with a stalk portion attached to the substrate at its bottom end and crested by an overhanging cap that is attached to the top end of the stalk portion, wherein some of the projections are oriented in a non-parallel configuration one to another thereby providing multiple flow channels therebetween across the substrate, wherein the first plurality of projections is oriented such that no straight fluid communication path can be drawn across the first surface of the substrate.

* * * * *